US006443023B1

(12) United States Patent
Kajino et al.

(10) Patent No.: US 6,443,023 B1
(45) Date of Patent: Sep. 3, 2002

(54) STARTER HAVING IMPROVED ELECTROMAGNETIC SWITCH

(75) Inventors: Sadayoshi Kajino, Nagoya; Yoshiharu Tomida, Chiryu; Masahiro Soh, Anjo, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 08/863,576

(22) Filed: May 27, 1997

(30) Foreign Application Priority Data

May 24, 1996 (JP) ..... 8-129420
Jun. 18, 1996 (JP) ..... 8-156490

(51) Int. Cl.[7] ..... F02N 11/00

(52) U.S. Cl. ..... 74/7 E; 74/7 R; 310/83; 335/123; 335/133; 290/38 R; 290/48

(58) Field of Search ..... 74/7 R, 7 E; 290/38 A, 290/38 R, 38 C, 48; 310/83; 335/133, 278, 126

(56) References Cited

U.S. PATENT DOCUMENTS

| | | | | |
|---|---|---|---|---|
| 3,232,123 A | * | 2/1966 | Wheatley | 74/7 R |
| 4,395,923 A | * | 8/1983 | Giometti | 74/7 R |
| 4,881,416 A | | 11/1989 | Isozumi | 74/7 R |
| 5,023,466 A | | 6/1991 | Isozumi | 74/7 R |
| 5,118,960 A | * | 6/1992 | Sasamoto et al. | 290/48 |
| 5,760,487 A | * | 6/1998 | Kimura et al. | 74/7 R |

FOREIGN PATENT DOCUMENTS

| | | | |
|---|---|---|---|
| CA | 700875 | * 12/1964 | 74/7 R |
| DE | 2507940 | * 9/1976 | 74/7 R |
| DE | 3906319 | * 9/1989 | 74/7 E |
| GB | 818595 | * 8/1959 | 74/7 R |
| JP | 2-275063 | * 11/1990 | 74/7 E |
| JP | 6-43979 | 11/1994 | |
| JP | 8-319925 | 12/1996 | |

* cited by examiner

*Primary Examiner*—John A. Jeffery
*Assistant Examiner*—William C Joyce
(74) *Attorney, Agent, or Firm*—Pillsbury Madison & Sutro LLP

(57) ABSTRACT

An electromagnetic switch for controlling an electric power supply to a starting motor is located in the periphery of one side of an output shaft in a radial direction thereof and coaxially with the output shaft. The electromagnetic switch has a motor contact connected with a power supply circuit for supplying brushes with electric power. The motor contact comprises a battery-side fixed contact formed integrally with a battery terminal, a motor-side fixed contact electrically connected with a positive brush through a lead wire and a plate, and a movable contact held by an end of a plunger. In the case where the electromagnetic switch is located not coaxially, the electromagnetic switch is shaped in a flat form and located in parallel with the output shaft so that the central axis thereof resides radially inside the outer periphery of a starting motor.

18 Claims, 4 Drawing Sheets

STARTER HAVING IMPROVED ELECTROMAGNETIC SWITCH

BACKGROUND OF THE INVENTION

1. Field of the Invention:

The present invention relates to a starter for starting an engine.

2. Description of Related Art:

Both a biaxial-type starter and a coaxial-type starter are known, for instance, by Laid-Open Japanese Utility Model Publication No. 6-43979 and Laid-Open Japanese Utility Model Publication No. 1-130071.

In the coaxial-type starter, an electromagnetic switch is positioned outward from an output shaft of a starter, a rotation shaft of an armature, in the radial direction thereof so that the electromagnetic switch is coaxial with the output shaft. This construction prevents the electromagnetic switch from projecting outward from the starting motor in the radial direction thereof. Therefore, electromagnetic switch of the coaxial-type starter can be installed on a car more easily than the biaxial starter.

In the coaxial-type starter, however, the distance between the electromagnetic switch and the starting motor in the axial direction of the rotation shaft is long and further, a commutator is provided at the side opposite to the side in which the output shaft of the starting motor is positioned. Thus, the wire connection construction for electrically connecting a fixed contact of the electromagnetic switch and the brush positioned on the commutator with each other is complicated, thus necessitating an increased number of installing processes to be performed. Moreover, the wire connecting the fixed contact and the brush with each other is long, thus causing the electric resistance of the wire to be large and hence degrading the output of the starter.

In the coaxial-type starter, the outer diameter of a plunger of the electromagnetic switch is large, which increases the diameter of the spool of an excitation coil. Consequently, the amount of copper of the excitation coil wound on the spool increases, which increases the weight of the starter.

Further, the plunger is cylindrical and therefore there is a possibility that the plunger is rotated under the influence of the vibration of the engine and that a sleeve provided inside the spool and other sliding-contact portions in the periphery of the plunger are worn.

Further, a battery terminal and a switch terminal project in the same direction in the radial direction of the electromagnetic switch and are proximate to each other. Thus, wires can be connected readily with the battery terminal and the switch terminal. However, the battery terminal and the switch terminal are so close to each other that wires interfere with each other and tools. The operation of installing the battery terminal and the switch terminal on the housing cannot be performed with ease.

SUMMARY OF THE INVENTION

It is therefore a first object of the present invention to provide a starter in which a wire connection between an electromagnetic switch and a brush can be accomplished readily.

It is a second object of the present invention to provide a starter having a construction which does not prevent the layout of an engine from being restricted and allows the use of a possible least amount of copper for use in a coil of an electromagnetic switch.

It is a third object of the present invention to provide a starter having a construction which prevents the rotation of a plunger against the vibration of an engine, thus restraining a peripheral part of the plunger from being worn.

It is a fourth object of the present invention to provide a starter having a construction which facilitates an operation of wiring a battery terminal and a switch terminal and installing them on a housing.

According to a first aspect of the present invention, an electromagnetic switch is positioned radially outwardly from a peripheral surface of a rotation shaft in an axial range between a commutator and an epicycle reduction gear and is coaxial with a rotation shaft, the distance between a brush which slides in contact with a commutator and the electromagnetic switch is made axially short. This construction facilitates the connection between a motor-side fixed contact and a positive brush and further, a wire connecting the motor-side fixed contact and the positive brush with each other is made short. Accordingly, the resistance of the wire is made small and the output of the starter can be improved.

According to a second aspect of the present invention, the axis of an electromagnetic switch substantially parallel with an output shaft is positioned inward from the peripheral surface of a starting motor in the radial direction of the output shaft. This construction restrains the peripheral part of a plunger from being worn because the rotation of the plunger is prevented and in addition, reduces the projection amount of the electromagnetic switch in the radial outward direction thereof. Further, a small amount of copper can be used for the attraction coil.

According to a third aspect of the present invention, the sectional shape of an electromagnetic switch perpendicular to the axis there of is flat in the radial direction of a starter. The projection amount of the electromagnetic switch can be reduced because it is flat in the radial direction of the starter compared with the case in which the electromagnetic switch is circular in the sectional shape. Moreover, the rotation of a plunger can be prevented against the vibration of an engine. Thus, the peripheral part of the plunger can be prevented from being worn.

According to a fourth aspect of the present invention, a battery terminal and a switch terminal project in the substantially same direction in the radial direction of an electromagnetic switch, so that they can be installed on the housing in the same direction and wires can be connected with the battery terminal and the switch terminal easily. Further, the wires connected therewith can be prevented from interfering with each other, and tools and the wires can be also prevented from interfering with each other, although they project in the same direction and proximate to each other. The battery terminal and the switch terminal are axially spaced at an appropriate interval from each other.

BRIEF DESCRIPTION OF THE DRAWINGS

Other objects, features and advantages of the present invention will become more apparent from the following detailed description when read with reference to the accompanying drawings, in which.

DETAILED DESCRIPTION OF PRESENTLY PREFERRED EMBODIMENTS

Figure 3:
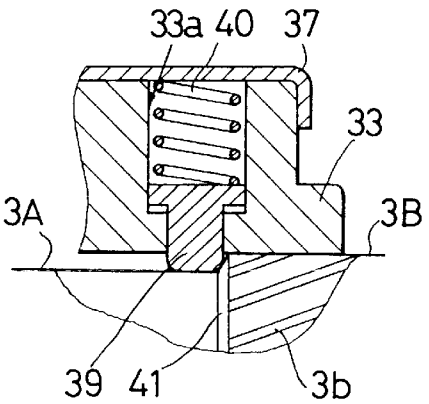
FIG. 3 is a sectional view showing a pinion return prevention mechanism of the starter shown in FIG. 1.

The present invention is described below with reference to various embodiments throughout which the same or similar parts are designated by the same reference numerals.

(First Embodiment)

Figure 1:
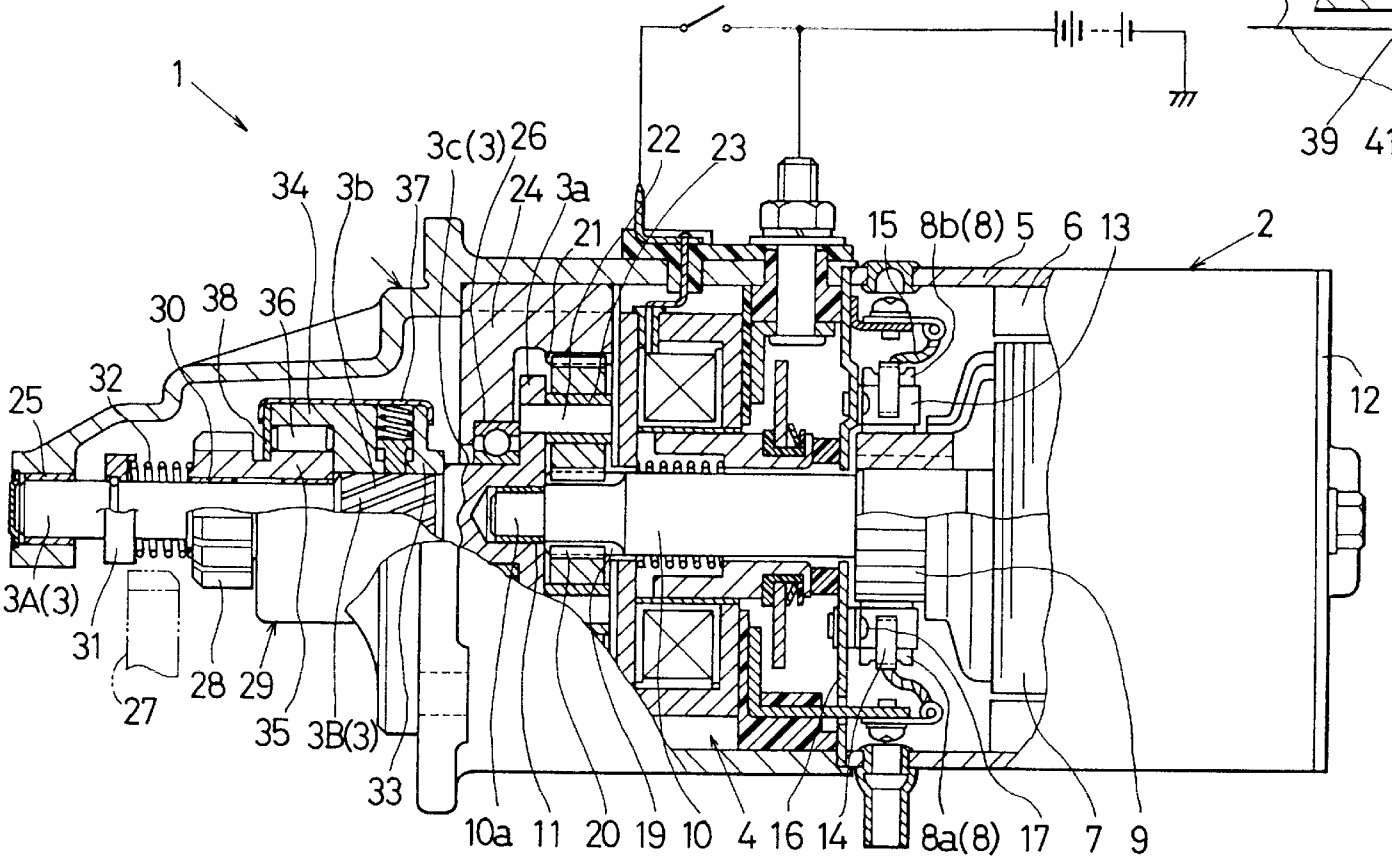
FIG. 1 is a sectional view showing a starter according to a first embodiment of the present invention.

A starter 1 comprises, as shown in FIG. 1, a starting motor 2; an epicycle speed reduction gear (described later) for reducing the rotational speed of the starting motor 2; an output shaft 3 rotating upon receipt of the rotational force of the epicycle reduction gear; and a pinion-moving member (described later) provided movably on the output shaft 3; and an electromagnetic switch 4 for controlling the electric power supply to the starting motor 2.

The starting motor 2 is a known DC motor comprising a yoke 5, a field device 6, for example, a permanent magnet; an armature 7; and brushes 8. The armature 7 has a cylindrical commutator 9 at one axial side (left-hand side in FIG. 1). One end of a rotation shaft 10 projecting from the commutator 9 to the left-hand side,in FIG. 1 is extended. A supporting portion 10*a* formed at one axial end of the extended portion of the rotation shaft 10 is supported in a concave formed at one axial end (right-hand side in FIG. 1) of the output shaft 3 by means of a bearing 11, whereas the other axial end of the rotation shaft 10 is supported by an unshown bearing fixed to an end frame 12.

The brushes 8 comprise a positive brush 8*a* and a negative brush 8*b* both held by a brush holder 13 on the peripheral surface of the commutator 9 such that each brush 8 moves in sliding contact with the commutator 9 in the radial direction thereof and urged to the commutator 9 by a brush spring 14. The positive brush 8*a* is insulated from the brush holder 13 through an unshown insulation material, and the negative brush 8*b* is grounded through a lead wire 15.

The brush holder 13 is fixed to a holder plate 16 by means of a rivet 17. The holder plate 16 is fixed between the yoke 5 and a housing 18, with the peripheral edge thereof engaging a stepped portion formed on an end surface of a housing 18.

The epicycle reduction gear comprises a sun gear 19 formed at one end (left-hand side in FIG. 1) of the extended portion of the rotation shaft 10; a plurality of planetary gears 20 engaging the sun gear 19; and an internal gear 21 engaging the planetary gears 20.

The sun gear 19 rotates together with the rotation shaft 10, thus transmitting the rotation of the rotation shaft 10 to the planetary gears 20. The planetary gears 20 are rotatably supported through a bearing 23 by a pin 22 inserted under pressure into a flange 3*a* formed on the periphery of the rear end of the output shaft 3. The planetary gears 20 engage the sun gear 19 and the internal gear 21, thus revolving around the sun gear 19 while rotating around the respective pins 22. The rotation of the internal gear 21 is regulated by the engagement between concaves and convexes formed on the peripheral surface of a gear-constituting member 24 and concaves and convexes formed on the inner peripheral surface of the housing 18.

The output shaft 3 is held coaxially with the rotation shaft 10 and is rotatably supported through a bearing 25 held by the housing 18 and a ball bearing 26 held by the gear-constituting member 24. The output shaft 3 comprises a small-diameter portion 3A, an intermediate-diameter portion 3B, and a large-diameter portion 3C. A helical spline 3*b* is formed on the peripheral surface of the intermediate-diameter portion 3B.

The pinion-moving member comprises a pinion 28 engageable with a ring gear 27 of an engine for transmitting the rotational force (rotation of output shaft 3) of the armature 7 to the ring gear 27; a one-way clutch 29 for transmitting the rotational force of the output shaft 3 to the pinion 28; and a pinion return prevention mechanism (described later) for preventing the rearward movement of the pinion-moving member in the period of time between the time when the pinion 28 engages the ring gear 27 and the time when the engine starts.

The pinion 28 engages the peripheral surface of the small-diameter portion 3A of the output shaft 3 rotatably through a bushing 30 and is movable on the output shaft 3 in sliding contact therewith together with the bushing 30. The forward movement of the pinion-moving member is regulated by the contact between the front end of the pinion 28 and a stop collar 31 positioned on the peripheral surface of the small-diameter portion 3A of the output shaft 3. A return spring 32 constantly urges the pinion-moving member rearward (right-hand side in FIG. 1) is installed on the peripheral surface of the small-diameter portion 3A such that return spring 32 is interposed between the stop collar 31 and the pinion 28.

The one-way clutch 29 comprises a spline tube 33 engaging the helical spline 3*b* of the output shaft 3; an outer member 34 integral with the spline tube 33; an inner member 35 positioned radially inwardly from the outer member 34 and integral with the pinion 28; rollers 36 interposed between the outer member 34 and the inner member 35; and a clutch cover 37 covering the peripheral surface of the outer member 34. The one-way clutch 29 transmits the rotation of the output shaft 3 transmitted to the spline tube 33 (namely, outer member 34) through the helical spline 3*b* to the inner member 35 (namely, pinion 28) through the rollers 36.

The pinion 28 integral with the inner member 35 is capable of moving axially together with the one-way clutch 29 because a plate 38 held by caulking between the front end surface of the outer member 34 and the clutch cover 37 regulates the movement of the inner member 35 in the axial direction of the output shaft 3.

As shown in FIG. 3, the pinion return prevention mechanism comprises a return prevention pin 39 inserted into a hole 33*a* formed in penetration through the spline tube 33 in the radial direction of the output shaft 3; and a spring 40 for urging the return prevention pin 39 inwardly in the radial direction of the output shaft 3. In the pinion return prevention mechanism, when the return prevention pin 39 moves from the peripheral surface of the intermediate-diameter portion 3B of the output shaft 3 to the peripheral surface of the small-diameter portion 3A of the output shaft 3, the return prevention pin 39 urged by the spring 40 drops to the peripheral surface of the small-diameter portion 3A, due to the forward movement (leftward in FIG. 1) of the pinion 28 on the output shaft 3. As a result, even though a return force is applied to the pinion-moving member, the front end of the return prevention pin 39 engages a gradually stepped portion 41 interposed between the small-diameter portion 3A and the intermediate-diameter portion 3B, thus preventing the return of the pinion-moving member.

Figure 2:
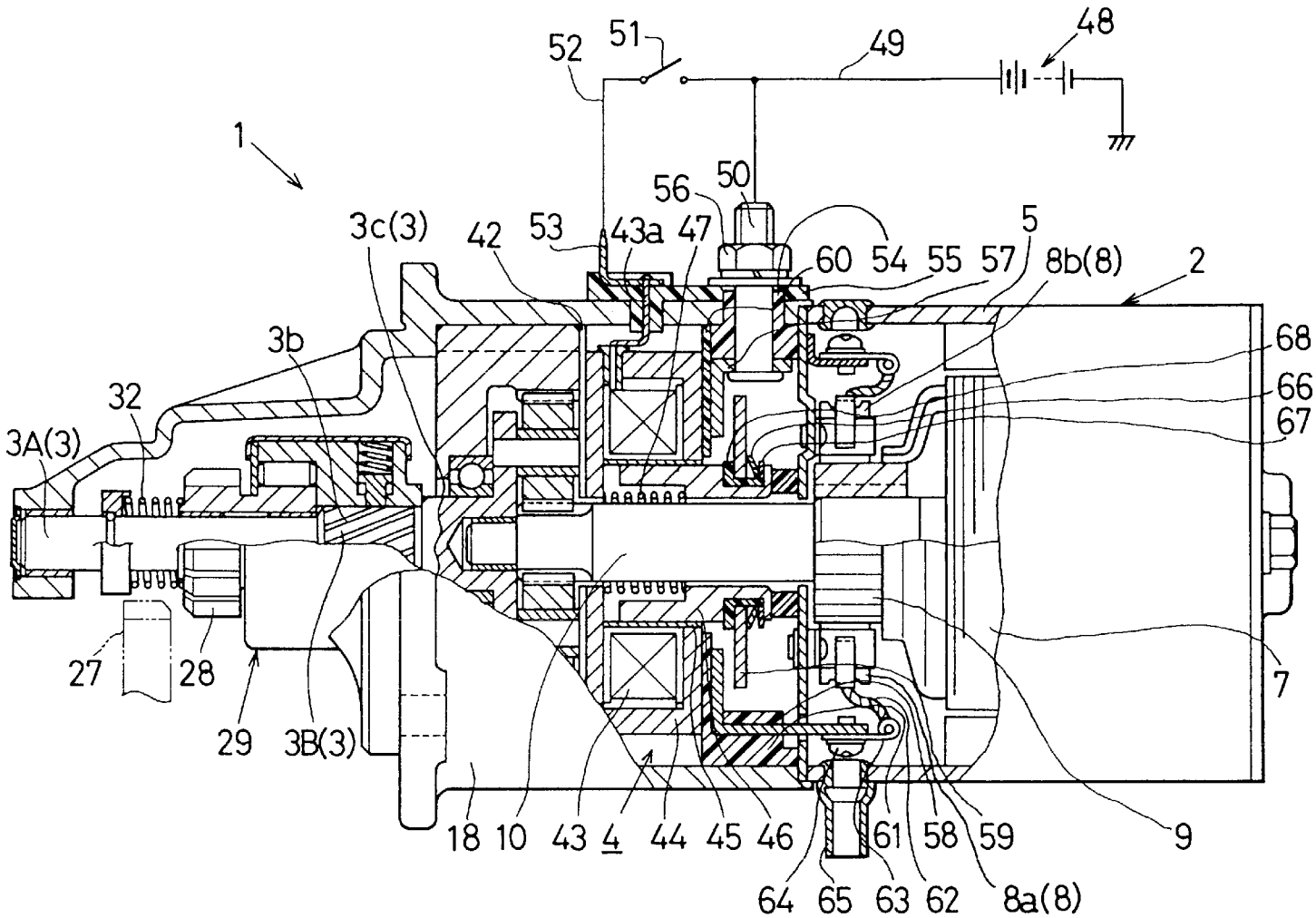
FIG. 2 is a sectional view showing in detail an electromagnetic switch of the starter shown in FIG. 1.

As shown in FIG. 2, the electromagnetic switch 4 coaxial with the rotation shaft 10 is positioned radially outwardly from the peripheral surface of the rotation shaft 10 in the range between the commutator 9 and the epicycle reduction gear. The electromagnetic switch 4 separated from the epicycle reduction gear through a partitioning washer 42.

The electromagnetic switch 4 comprises a coil 43 generating a magnetic force when it is energized with electric current; a core 44 covering the coil 43 and constituting a part of a magnetic circuit; a cylindrical sleeve 45 positioned on the inner peripheral surface of the coil 43; a plunger 46 (constituting a part of the magnetic circuit) held on the inner peripheral surface of the sleeve 45 such that the plunger 46 moves in sliding contact with the inner peripheral surface thereof; a spring 47 urging the plunger 46 axially (right-hand direction in FIG. 2); an external terminal (described later) connected with an external wiring and a motor contact (described later) connected with a power supply circuit for supplying the brush 8 with electric power.

The external terminal comprises a battery terminal 50 connected with a cable 49 directly connected with a battery 48 and a switch terminal 53 connected with a wiring 52 extending from a key switch 51.

The battery terminal 50 is fastened with a nut 56 to the housing 18 through insulation bushings 54 and 55. The switch terminal 53 is held by the housing 18 through the insulation bushing 55 insulating the battery terminal 50 and soldered to a lead wire 43*a* extending from the coil 43 through the insulation bushing 55.

The motor contact comprises a battery-side fixed contact 57 fixed to one end of the housing 18; a motor-side fixed contact 58 connected with the positive brush 8*a;* and a movable contact 59 which is brought into contact with the battery-side fixed contact 57 and the motor-side fixed contact 58.

An insulation member 60 insulates the battery-side fixed contact 57 from the core 44. The motor-side fixed contact 58 is formed on an insulation member 61 by molding and insulated from the core 44 and the housing 18.

The motor-side fixed contact 58 is fixed by the plate 63 connected with a lead wire 62 of the positive brush 8*a* and by a screw 64, thus being electrically connected with the positive brush 8*a*. The screw 64 is tightened into the plate 63 by inserting the screw 64 through a hole formed on the yoke 5. After the tightening of the screw 64 is completed, a ventilation pipe 65 is installed in the hole of the yoke 5.

The movable contact 59 is held by one end of the plunger 46 by caulking through a contact pressure-applying belleville spring 66 and insulation members 67 and 68.

The starter of the first embodiment operates as follows.

When the key switch 51 is closed, electric current flows from the battery 48 to the coil 43 through the switch terminal 53. Upon receipt of a magnetic force generated by the coil 43, the plunger 46 is attracted to the coil 43. As a result, the plunger 46 moves axially inside the sleeve 45 to the left-hand side in FIGS. 1 and 2 against the urging force of the spring 47. As a result, the movable contact 59 held by the plunger 46 contacts the battery-side fixed contact 57 and the motor-side fixed contact 58, thus turning on the battery-side fixed contact 57 and the motor-side fixed contact 58. Consequently, the armature 7 is energized with electric current through the brushes 8, thus starting to rotate.

The epicycle reduction gear reduces the rotation speed of the armature 7, thus transmitting it to the output shaft 3. Upon rotation of the output shaft 3, the pinion-moving member moves axially forward on the output shaft 3 owing to the operation of the helical spline 3*b* and the inertia of the one-way clutch 29. Consequently, the pinion 28 engages the ring gear 27. At this time, as shown in FIG. 3, the return prevention pin 39 provided inside the spline tube 33 drops from the peripheral surface of the intermediate-diameter portion 3B to the peripheral surface of the small-diameter portion 3A of the output shaft 3 and is urged by the spring 40, thus engaging the stepped portion 41 formed gradually between the small-diameter portion 3A and the intermediate-diameter portion 3B. Therefore, the pinion-moving member is prevented from being moved axially backward on the output shaft 3 against the urging force of the return spring 32.

The rotational force of the armature 7 transmitted to the output shaft 3 is transmitted from the pinion 28 to the ring gear 27. As a result, the ring gear 27 rotates, thus starting the engine. When the rotational speed of the output shaft 3 reaches the vicinity of the no-load rotational speed of the starting motor 2, the centrifugal force causes the return prevention pin 39 to move outward in the radial direction of the output shaft 3 against the urging force of the spring 40. Thus, the lower end of the return prevention pin 39 disengages from the stepped portion 41 formed between the small-diameter portion 3A and the intermediate-diameter portion 3B. Consequently, the pinion-moving member is allowed to move rearward. As a result, a retraction force generated by the rotational force of the engine is transmitted to the pinion-moving member through the helical spline 3*b,* and the urging force of the return spring 32 is applied thereto. As a result, the pinion-moving member moves rearward on the output shaft 3, thus returning to the rest position (position shown in FIGS. 1 and 2). After the pinion-moving member returns to the rest position, the key switch 51 is turned off to stop the supply of electric power to the armature 7. As a result, the operation of the starter 1 stops.

In the starter of the first embodiment, because the electromagnetic switch 4 is positioned radially outside from the peripheral surface of the rotation shaft 10 in the axial range between the commutator 9 and the epicycle reduction gear and is coaxial with the rotation shaft 10, the distance between the brush 8 which slides in contact with the commutator 9 and the electromagnetic switch 4 is allowed to be axially short. This construction permits the motor-side fixed contact 58 to be provided in proximity to the positive brush 8*a,* thus facilitating the connection between the motor-side fixed contact 58 and the positive brush 8*a*. Further, because the lead wire 62 of the positive brush 8*a* is connected with the motor-side fixed contact 58 through the plate 63, the lead wire which connects the motor-side fixed contact 58 and the positive brush 8*a* with each other is allowed to be short. Accordingly, the electric resistance of the lead wire is small and the output of the starter 1 can be improved.

It is not necessary for the electromagnetic switch 4 of the first embodiment to generate the force of pressing the pinion-moving member forward, but merely to open and close the motor contact (to drive the movable contact 59). Thus, only the coil 43 is required to press the pinion-moving member forward. In the case of a starter in which the pinion 28 is pressed forward by the attraction force of the electromagnetic switch 4, an attraction coil and a holding coil are required to press the pinion 28 forward. However, in the starter 1 of the first embodiment, only the coil 43 corresponding to the holding coil is sufficient for pressing the pinion 28 forward.

In the first embodiment, the return prevention pin 39 and the spring 40 are used in combination to constitute the pinion return prevention mechanism various methods can be adopted to constitute the pinion return prevention mechanism. For example, a ball and a weight may be used to constitute it.

(Second Embodiment)

Figure 4:
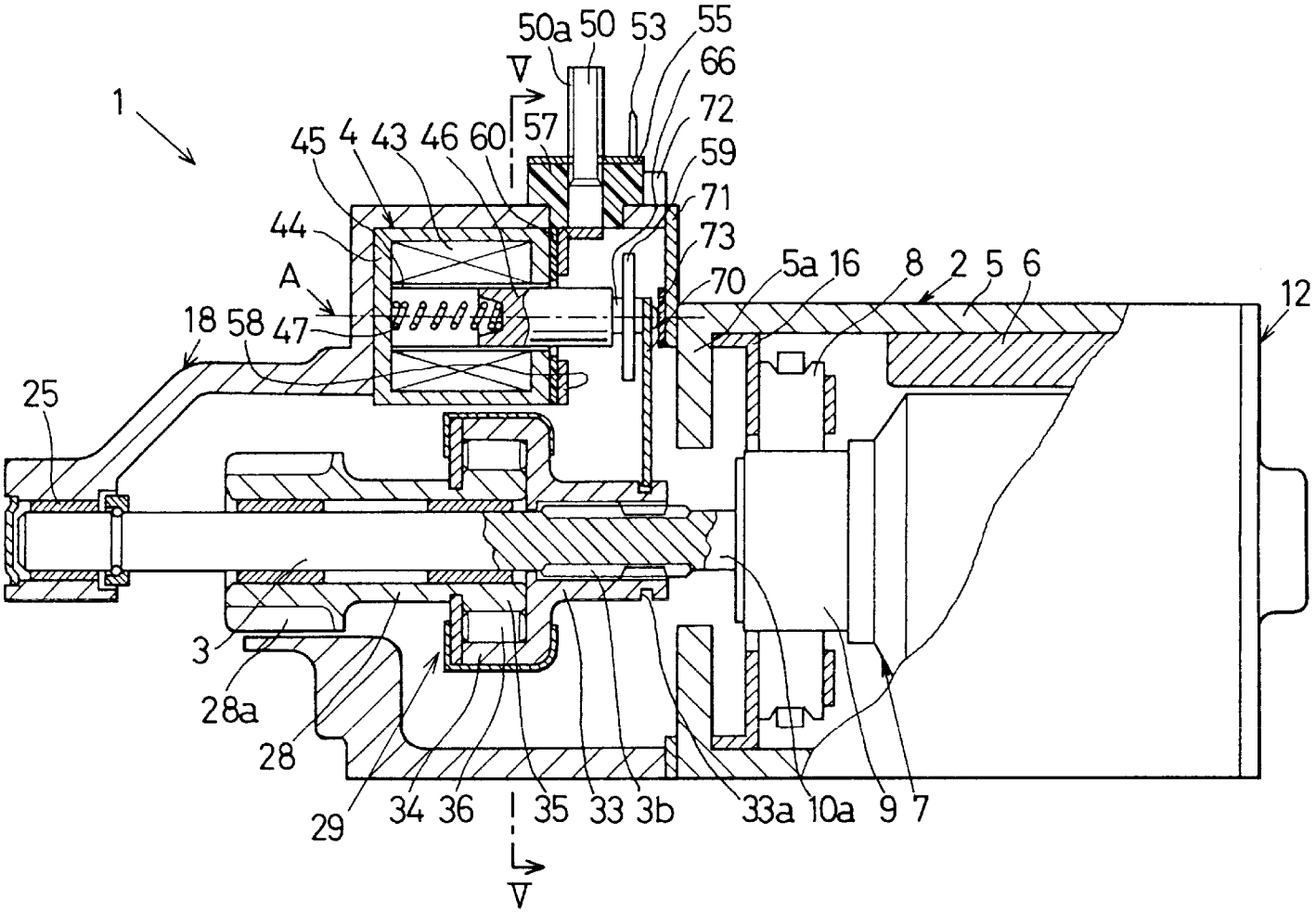
FIG. 4 is a sectional view showing a starter according to a second embodiment of the present invention.

A starter 1 comprises, as shown in FIG. 4, a starting motor 2 for generating a rotational force; an output shaft 3 which is driven by the starting motor 2; a one-way clutch 29 engaging the output shaft 3; a pinion 28 which slidably moves on the output shaft 3 together with the one-way clutch 29; and an electromagnetic switch 4 for controlling an electric power to be supplied to the starting motor 2 and urging the pinion 28 and the one-way clutch 29 toward an unshown ring gear of an engine through a lever 70.

The starting motor 2 comprises a yoke 5 serving as an outer frame of the starter 1 and constituting a part of a magnetic circuit a fixed magnetic pole 6 fixed to the inner peripheral surface of the yoke 5; an armature 7 positioned inward from the fixed magnetic pole 6 in the radial direction of an armature shaft or rotation shaft 10*a;* and brushes 8 for supplying the armature 7 with electric power.

The yoke 5 comprising a bottom 5*a* is cylindrical. The end (end in right-hand side in FIG. 4) of the open part of the yoke 5 is closed with an end frame 12. The fixed magnetic pole 6 is composed of a plurality of permanent magnets arranged on the inner peripheral surface of the yoke 5 at regular intervals in the circumferential direction thereof.

The rotation shaft 10*a* of the armature 7 is integral with the output shaft 3 such that one axial end (left-hand side in FIG. 4) of the rotation shaft 10*a* is extended to be continuous with one axial end (right-hand side in FIG. 4) of the output shaft 3. The other axial end (left-hand side in FIG. 4) of the output shaft 3 is rotatably supported by a bearing 25 fixed to a housing 18. The other axial end (right-hand side in FIG. 4) of the rotation shaft 10*a* is rotatably supported by an unshown bearing fixed to the end frame 12.

Each brush 8 is positioned outward from the commutator 9 installed at one side of the armature 7 in the radial direction thereof. The brush 8 is urged toward the commutator 9 by a brush spring and held by a brush holder 16 such that the brush 8 moves in sliding contact with the brush holder 16.

As described above, the output shaft 3 is integral with the rotation shaft 10*a* of the armature 7, thus rotating together with the rotation shaft 10*a* when the starting motor 2 is actuated. A helical spline 3*b* is formed on the peripheral surface of the output shaft 3 such that the helical spline 3*b* is positioned in the vicinity of the armature 7.

The one-way clutch 29 comprises a spline tube 33 having a helical spline formed on the inner peripheral surface thereof and engaging the helical spline 3*b* of the output shaft 3; an outer member 34 integral with the spline tube 33 and having wedge-shaped cam chambers 34*a* (FIG. 5) formed on the inner peripheral surface thereof; an inner member 35 positioned inward from the outer member 34 in the radial direction of the output shaft 3 and rotatably engaging the output shaft 3 through a bearing a plurality of rollers 36 accommodated in the cam chambers 34*a* of the outer member 34; and a plurality of springs 34*b* (FIG. 5) each urging one of the rollers 36 toward the narrow side of each cam chamber 34*a*. The pinion 28 is integral with the inner member 35 and rotatably engages the output shaft 3 through a bearing at a position in front (left-hand side in FIG. 4) of the inner member 35. The pinion 28 has a pinion gear 28*a* formed on the peripheral surface thereof. The pinion gear 28*a* engages the ring gear of the engine, thus transmitting the rotational force of the starting motor 2 to the ring gear.

The electromagnetic switch 4 is positioned outward from the output shaft 3 in the radial direction thereof such that the electromagnetic switch 4 is positioned between the pinion gear 28*a* and the armature 7 in the axial direction of the output shaft 3. The axis A of the switch 4 is positioned to be substantially parallel with the output shaft 3. The electromagnetic switch 4 comprises an attraction coil 43 generating a magnetic force when it is energized with electric current; a frame 44 covering the attraction coil 43 and constituting a part of the magnetic circuit; a cylindrical sleeve 45 positioned inward from the attraction coil 43 in the radial direction of the electromagnetic switch 4; a plunger 46 positioned inside the sleeve 45 such that the plunger 46 is slidable in contact with the inner peripheral surface of the sleeve 45; a return spring 47 constantly urging the plunger 46 rearward (right-hand side in FIG. 4); an internal contact (described later) opening and closing a power supply circuit connected with the starting motor 2; and an external circuit (described later) connecting the electromagnetic switch 4 with an external wire. The plunger 46 urged by the return spring 47 is stationary in contact with an elastic member 73 positioned at the rear of the plunger 46. The elastic member 73 is installed on a flat plate-shaped member 71 fixed between the bottom 5*a* of the yoke 5 and the rear end surface of the housing 18.

The internal contact comprises a motor-side fixed contact 58 and a battery-side fixed contact 57 both fixed to the rear end surface of the frame 44 through an insulation member 60; and a movable contact 59 fixed to the rear end of the plunger 46 through an insulating elastic member 66. The motor-side fixed contact 58 is electrically connected with the positive brush 8 (brush 8 positioned at upper side in FIG. 4) through an unshown lead wire. The movable contact 59 moves together with the plunger 46, thus contacting the motor-side fixed contact 58 and the battery-side fixed contact 57 and turning them on.

The external terminal comprises a battery terminal 50 connected with a wire directly connected with an unshown battery and a switch terminal 53 connected with a wire connected with an unshown key switch. The battery terminal 50 and the switch terminal 53 project radially outwardly from the electromagnetic switch 4 such that the battery terminal 50 and the switch terminal 53 are axially spaced apart by an appropriate interval. They are held by insulation members 55 and 72, respectively and insulated from the housing 18. The battery terminal 50 is integral with the battery-side fixed contact 57 and has a thread portion 50*a* formed on the periphery of its upper part projecting outward from the housing 18. The thread portion 50*a* connects a wire connected with the battery with the battery terminal 50. The wire of the switch terminal 53 accommodated in the housing 18 is connected with an unshown leading wire of the attraction coil 43.

Figure 5:
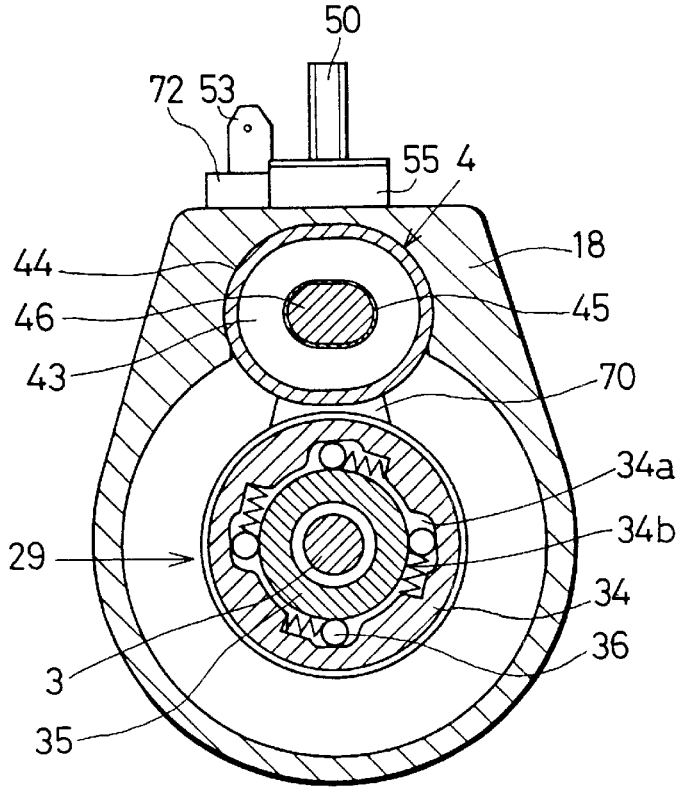
FIG. 5 is a sectional view taken along a line V—V in FIG. 4.

As shown in FIG. 5, in a sectional view of the electromagnetic switch 4, the diameter in the horizontal direction and that in the vertical direction are different from each other. That is, the respective constituent parts of the electromagnetic switch 4, namely, the frame 44, the attraction coil 43, the sleeve 45, and the plunger 46 are elliptic (flat in the radial direction of the starter 1). Further, the axis A of the electromagnetic switch 4 is positioned inward from the peripheral surface of the starting motor 2 (peripheral surface of yoke 5) in the radial direction of the rotation shaft 10*a*.

The lever 70 which is driven by the electromagnetic switch 4 is made of a flat plate-shaped elastic material. One end of the lever 70 is fixed to the rear end of the plunger 46, and the other end thereof is connected with a groove 33*a* formed on the peripheral surface of the spline tube 33.

The starter of the second embodiment operates as follows.

When the key switch is turned on, electric current flows to the attraction coil 43 through the switch terminal 53. As a result, the attraction coil 43 generates a magnetic force, thus attracting the plunger 46 thereto. Consequently, the plunger 46 moves forward together with the movable contact 59 and the lever 70, namely, leftward in FIG. 4 in the sleeve 45 against the urging force of the return spring 47. As a result, the one-way clutch 29 is pressed by the lever 70, thus moving axially forward on the output shaft 3 together with the pinion 28. When the end surface of the pinion gear 28*a* has contacted the end surface of the ring gear, the forward movement of the one-way clutch 29 and that of the pinion 28 are stopped, whereas the plunger 46 continues to move forward, with the plunger 46 flexing the lever 70 because the plunger 46 is kept to be attracted by the attraction coil 43. The plunger 46 stops moving forward when the rear end surface thereof has reached the bottom: surface of the frame 44 after the movable contact 59 contacts the motor-side fixed contact 58 and the battery-side fixed contact 57.

When the motor-side fixed contact 58 and the battery-side fixed contact 57 are turned on as a result of the contact between the movable contact 59 and both fixed contacts 57 and 58, electric current flows through the armature 7 through the brushes 8 and the commutator 9, thus rotating the armature 7. The pinion 28 rotates due to the rotation of the armature 7. When the position of contact between the pinion gear 28*a* and the ring gear at which both can engage each other, the one-way clutch 29 and the pinion 28 are pressed forward by the reaction force of the lever 70. As a result, the pinion gear 28*a* engages the ring gear, thus transmitting the rotational force of the armature 7 to the ring gear. Consequently, the engine starts.

When the key switch is turned off after the engine is ignited, the supply of electric power to the attraction coil 43 is stopped. As a result, the plunger 46 is moved backward by the urging force of the return spring 47, thus contacting the elastic member 73. At this time, a great shock is applied to the flat plate-shaped member 71 through the elastic member 73. The deformation of the flat plate-shaped member 71 can be prevented because it is thick and held by the bottom 5*a* of the rigid yoke 5.

According to the second embodiment, the central axis A of the electromagnetic switch 4 is substantially parallel with the output shaft 3 and is positioned inward from the outer peripheral surface of the starting motor 2 in the radial direction. Further, the sectional shape of the electromagnetic switch 4 is flat in the radial direction of the starter 1. This construction allows the projection amount of the electromagnetic switch 7 in the radial outward direction of the starter 1 to be smaller than that of the conventional biaxial starter. Thus, the starter 1 can be readily installed on a car. In addition, the plunger 46 of the second embodiment is smaller than that of the conventional biaxial starter in which the plunger is solid, and the hollow plunger is provided radially outwardly from the output shaft 3. Consequently, the outer diameter of the sleeve 45 can be made small, which reduces the amount of copper which is used for the attraction coil 43, the weight of the starter 1, and the manufacturing cost.

The sectional shape of the electromagnetic switch 4 is flat in the radial direction of the starter 1 to prevent the rotation of the plunger 46 against the influence of the vibration of the engine. Thus, the abrasion of the sliding portion (for example, sleeve 45) in the periphery of the plunger 46 can be prevented.

Further, because the battery terminal 50 and the switch terminal 53 project in substantially the same direction in the radial direction of the electromagnetic switch 4, they can be installed on the housing 18 in the same direction. Therefore, a wiring operation can be accomplished readily. Further, wires connected with the battery terminal 50 and the switch terminal 53 can be prevented from interfering with each other, and the wires and the tools can be prevented from interfering with each other, although they project in the same direction and proximate to each other. This is because the battery terminal 50 and the switch terminal 53 are axially spaced at an appropriate interval.

(Third Embodiment)

Figure 6:
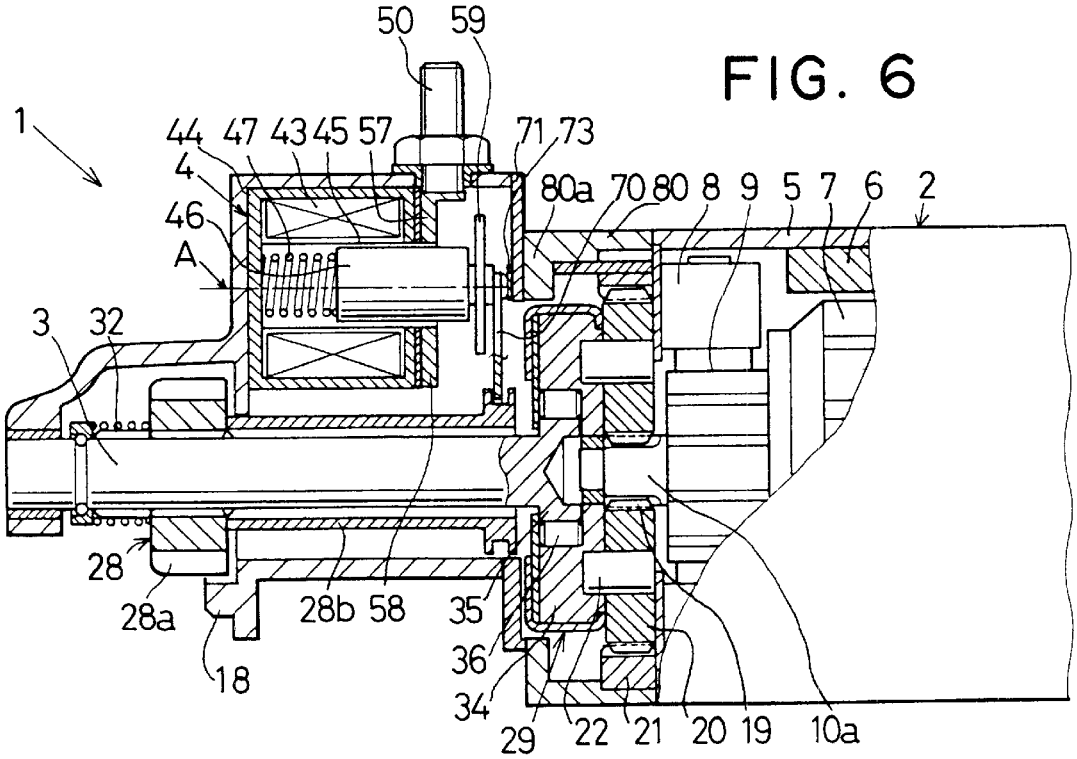
FIG. 6 is a sectional view showing a starter according to a third embodiment of the present invention.

A starter 1 of the third embodiment comprises, as shown in FIG. 6, a starting motor 2 for generating a rotational force; an epicycle speed reduction gear (described later) for reducing the rotational speed of the starting motor 2; a one-way clutch 29 transmitting the rotational force of the epicycle reduction gear to an output shaft 3; a pinion 28 engaging the output shaft 3; an electromagnetic switch 4 for controlling an electric power to be supplied to the starting motor 2 and urging the pinion 28 toward a ring gear of an engine through a lever 70 and a pinion sleeve 28*b*.

Similarly to the second embodiment, the starting motor 2 comprises a yoke 5; a fixed magnetic pole 6; an armature 7; and brushes 8. The epicycle reduction gear comprises a sun gear 19 formed on the peripheral surface of the rotation shaft 10*a* of the armature 7 at one end thereof; a plurality of planetary gears 20 engaging the sun gear 19; and an internal gear 21 engaging the planetary gears 20. The sun gear 19 rotates together with the rotation shaft 10*a*, thus transmitting the rotation thereof to the planetary gears 20. The planetary gears 20 are rotatably supported through respective pins 22 fixed to an outer member 34, thus revolving around the sun gear 19 while rotating on the respective pins 22, subjected to the rotation of the sun gear 19. The rotation of the internal gear 21 is regulated by a center case 80 covering the epicycle reduction gear and the one-way clutch 29.

The one-way clutch 29 comprises an outer member 34 which rotates, subjected to the revolving force of the respective planetary gears 20 generated by their rotations around the sun gear 19; an inner member 35 positioned on the periphery of the tear end of the output shaft 3; rollers 36 interposed between the outer member 34 and the inner member 35.

The pinion 28 engages the peripheral surface of the output shaft 3 through a helical spline. A pinion gear 28*a* engaging the ring gear is formed on the peripheral surface of the pinion 28. A spring 32 for urging the pinion 28 rearward is positioned in front of the pinion 28.

The electromagnetic switch 4 is positioned radially outside the output shaft 3 such that the electromagnetic switch 4 is positioned between the pinion 28 and the armature 7 in the axial direction of the output shaft 3 and that the central axis A of the electromagnetic switch 4 is substantially parallel with the output shaft 3. Similarly to the second embodiment, the electromagnetic switch 4 comprises an attraction coil 43; a frame 44; a sleeve 45; a plunger 46; a return spring 47; a motor-side fixed contact 58; a battery-side fixed contact 57; a movable contact 59; a battery terminal 50; and an unshown switch terminal. A flat plate-shaped member 71 holding the elastic member 73 into which the plunger 46 is brought at the rest position is held by the bottom 80*a* of the center case 80.

In a sectional view of the electromagnetic switch 4, its diameter in the horizontal direction and that in the vertical direction are different from each other in the same manner as in the second embodiment shown in FIG. 5. That is, the respective constituent parts of the electromagnetic switch 4, namely, the frame 44, the attraction coil 43, the sleeve 45, and the plunger 46 are flat in the radial direction of the starter 1. Further, the axis A of the electromagnetic switch 4 is positioned inward from the outer peripheral surface of the starting motor 2 (peripheral surface of yoke 5) in the radial direction thereof.

The lever 70 which is driven by the electromagnetic switch 4 is made of a flat plate-shaped elastic material. One end of the lever 70 is fixed to one end of the plunger 46, and the other end thereof is connected with a pinion sleeve 28*b* slidably engaging the peripheral surface of the output shaft 3.

The starter of the third embodiment operates as follows.

When the key switch is closed, electric current flows through the attraction coil 43. As a result, the attraction coil 43 generates a magnetic force, thus attracting the plunger 46 thereto. Consequently, the plunger 46 moves forward (left-hand side in FIG. 6) in the sleeve 45 against the urging force of the return spring 47. Due to the movement of the plunger 46, the movable contact 59 and the lever 70 move. As a result, the pinion sleeve 28*b* is pressed by the lever 70, with the result that the pinion 28 pressed by the pinion sleeve 28*a* moves forward on the output shaft 3 along the helical spline. When the end surface of the pinion gear 28*a* has contacted the end surface of the ring gear, the pinion sleeve 28*b* and the pinion 28 stop moving forward, whereas the plunger 46 continues moving forward, with the plunger 46 flexing the lever 70 because the plunger 46 is kept to be attracted to the attraction coil 43; The plunger 46 stops moving forward when the rear end surface of the plunger 46 has reached the bottom surface of the frame 44 after the movable contact 59 contacts the motor-side fixed contact 58 and the battery-side fixed contact 57.

When the motor-side fixed contact 58 and the battery-side fixed contact 57 are turned on as a result of the contact between the movable contact 59 and both fixed contacts 57 and 58, electric current flows through the armature 7 through the brushes 8 and the commutator 9, thus rotating the armature 7. The pinion 28 rotates due to the rotation of the armature 7. When the position of contact between the pinion gear 28*a* and the ring gear at which both can engage each other, the pinion sleeve 28*b* and the pinion 28 are pressed forward by the reaction force of the lever 70. As a result, the pinion gear 28*a* engages the ring gear, thus transmitting the rotational force of the armature 7 to the ring gear. Consequently, the engine starts.

When the key switch is turned off after the engine is ignited, the supply of electric power to the attraction coil 43 is stopped. As a result, the plunger 46 is moved backward by the urging force of the return spring 47, thus contacting the elastic member 73 At this time, a great shock is applied to the flat plate-shaped member 71 through the elastic member 73. The deformation of the flat plate-shaped member 73 can be prevented because it is thick and held by the bottom 80*a* of the rigid center case 80.

According to the third embodiment as well as the second embodiment, the axis A of the electromagnetic switch 4 substantially parallel with the output shaft 3 is positioned inward from the peripheral surface of the starting motor 2 in the radial direction of the output shaft 3. Further, the sectional shape of the electromagnetic switch 4 is flat in the radial direction of the starter 1. This construction allows the projection amount of the electromagnetic switch 4 in the radial outward direction of the starter 1 to be smaller than that of the conventional biaxial starter. Thus, the starter 1 can be readily installed on a car. Because the electromagnetic switch 4 is positioned in the space between the pinion 28 and the one-way clutch 29 in the axial direction of the output shaft 3, the axis A of the electromagnetic switch 4 can be positioned closer to the output shaft 3 than the one of the second embodiment. Therefore, the projection amount of the electromagnetic switch 4 can be allowed to be small radially. The amount of copper which is used for the attraction coil 43 can be reduced, and hence the weight of the starter 1 and the manufacturing cost can be reduced.

The sectional shape of the electromagnetic switch 4 is flat in the radial direction of the starter 1 to prevent the rotation of the plunger 46 against the influence of the vibration of the engine. Thus, the abrasion of the sliding portion (for example, sleeve 45) in the periphery of the plunger 46 can be prevented.

Further, the battery terminal 50 and the switch terminal (not shown) can be installed to project in the substantially same direction in the radial direction of the electromagnetic switch 4. Therefore, a wiring operation can be accomplished readily and wires connected with the battery terminal 50 and the switch terminal can be prevented from interfering with each other.

The present invention should not be limited to the disclosed embodiments but may be modified further in various ways without departing from the scope and spirit of the invention.

What is claimed is:

1. A starter comprising:

a starting motor having an armature to generate rotational force when supplied with electric power through a brush slidable in contact with a commutator positioned at one axial end of the armature;

an epicycle reduction gear, positioned at one axial end of a rotation shaft projecting axially from the commutator, for reducing a rotation speed of the armature;

an output shaft coaxial with the rotation shaft and rotatable by a rotational force of the epicycle reduction gear;

a pinion-moving member having a pinion engageable with a ring gear of an engine and axially movable on the output shaft along a helical spline; and an electromagnetic switch having a motor contact connected with the brush for controlling electric power supply to the brush the electromagnetic switch being positioned radially outside an outer peripheral surface of the rotation shaft axially between the commutator and the epicycle reduction gear and coaxially with the rotation shaft.

2. The starter according to claim 1, wherein the motor contact includes:

a battery-side fixed contact electrically connectable with a battery through a battery terminal;

a motor-side fixed contact electrically connected with the brush; and a movable contact for selectively electrically connecting the battery-side fixed contact and the motor-side fixed contact.

3. The starter according to claim 1, further comprising a gear-constituting member disposed between the pinion moving member and the epicycle reduction gear.

4. The starter according to claim 1, wherein an axis of the electromagnetic switch is substantially parallel with the output shaft and is positioned radially inwardly from a peripheral surface of the starting motor.

5. A starter comprising:

a starting motor including an armature, a commutator positioned at one axial end of the armature, a brush in slidable contact with said commutator, and a rotation shaft projecting axially from the commutator;

an epicycle reduction gear, positioned adjacent one axial end of said rotation shaft for reducing a rotation speed of the armature;

an output shaft coaxial with the rotation shaft and rotatable by a rotational force of the epicycle reduction gear;

a pinion-moving member having a pinion engageable with a ring gear of an engine and axially movable on the output shaft along a helical spline; and an electromagnetic switch having a motor contact operatively connected with the brush for controlling electric power supply to the brush, wherein the commutator is provided at a pinion-moving member side of the starting motor, and the electromagnetic switch is positioned axially between the commutator and the epicycle reduction gear.

6. The starter according to claim 5, wherein the motor contact includes:

a battery-side fixed contact electrically connectable with a battery through a battery terminal;

a motor side fixed contact electrically connected with the brush; and a movable contact for selectively electrically connecting the battery-side fixed contact and the motor-side fixed contact.

7. The starter according to claim 6, wherein the battery terminal protrudes radially outwardly relative to the axis of the rotation shaft.

8. The starter according to claim 7, further comprising:

a housing accommodating the pinion moving member, the electromagnetic switch and the epicycle reduction gear therein, wherein the battery terminal is fixed to the housing.

9. The starter according to claim 5, further comprising a gear-constituting member disposed between the pinion moving member and the epicycle reduction gear.

10. The starter according to claim 5, wherein an axis of the electromagnetic switch is substantially parallel with the output shaft and is positioned radially inwardly from a peripheral surface of the starting motor.

11. A starter comprising:

a starting motor including an armature, a commutator positioned at one axial end of the armature, a brush in slidable contact with said commutator, and a rotation shaft projecting axially from the commutator;

an epicycle reduction gear, positioned adjacent one axial end of said rotation shaft for reducing a rotation speed of the armature;

an output shaft coaxial with the rotation shaft and rotatable by a rotational force of the epicycle reduction gear;

a pinion-moving member having a pinion engageable with a ring gear of an engine and axially movable on the output shaft along a helical spline; and an electromagnetic switch having a motor contact operatively connected with the brush for controlling electric power supply to the brush, wherein the motor contact is positioned adjacent to a side of the commutator, the commutator being positioned at a pinion-moving member side of the starting motor and the electromagnetic switch is positioned axially between the commutator and the epicycle reduction gear.

12. The starter according to claim 11, wherein the motor contact includes:

a battery-side fixed contact electrically connectable with a battery through a battery terminal;

a motor-side fixed contact electrically connected with the brush; and a movable contact for selectively electrically connecting the battery-side fixed contact and the motor-side fixed contact.

13. The starter according to claim 11, wherein:

the pinion moving member is constructed to move toward a ring gear of an engine in response to rotation of the output shaft rotated by the starting motor.

14. The starter according to claim 11, wherein:

the commutator is provided at a side of the pinion-moving member.

15. The starter according to claim 11, further comprising:

a housing having a cylindrical part which has a substantially uniform diameter and accommodates the pinion moving member, the electromagnetic switch and the epicycle reduction gear therein.

16. The starter according to claim 15, wherein:

the battery terminal protrudes radially outward from the housing.

17. The starter according to claim 11, further comprising a gear-constituting member disposed between the pinion moving member and the epicycle reduction gear.

18. The starter according to claim 11, wherein an axis of the electromagnetic switch is substantially parallel with the output shaft and is positioned radially inwardly from a peripheral surface of the starting motor.

* * * * *